US007367404B2

(12) United States Patent
Simpson et al.

(10) Patent No.: US 7,367,404 B2
(45) Date of Patent: May 6, 2008

(54) TUBING SEAL

(75) Inventors: Neil Andrew Abercrombie Simpson, Aberdeen (GB); Alexander Craig Mackay, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 143 days.

(21) Appl. No.: 10/990,331

(22) Filed: Nov. 16, 2004

(65) Prior Publication Data

US 2005/0127673 A1 Jun. 16, 2005

Related U.S. Application Data

(63) Continuation-in-part of application No. 10/102,543, filed on Mar. 20, 2002, now abandoned, and a continuation-in-part of application No. 10/750,208, filed on Dec. 31, 2003, now Pat. No. 7,124,826, which is a continuation of application No. 10/217,833, filed on Aug. 13, 2002, now Pat. No. 6,702,030, which is a continuation of application No. 09/469,690, filed on Dec. 22, 1999, now Pat. No. 6,457,532.

(51) Int. Cl.
*E21B 23/01* (2006.01)
*E21B 17/02* (2006.01)

(52) U.S. Cl. ..... 166/380; 166/206; 166/242.6; 166/382

(58) Field of Classification Search ..... 166/380, 166/382, 206, 207, 212, 242.1, 242.6
See application file for complete search history.

(56) References Cited

U.S. PATENT DOCUMENTS 761,518 A 5/1904 Lykken
1,324,303 A 12/1919 Carmichael
1,545,039 A 7/1925 Deavers
1,561,418 A 11/1925 Duda
1,569,729 A 1/1926 Duda
1,597,212 A 8/1926 Spengler
1,930,825 A 10/1933 Raymond
1,981,525 A 11/1934 Price
2,383,214 A 4/1945 Prout et al.

(Continued)

FOREIGN PATENT DOCUMENTS

GB 1551816 2/1975

(Continued)

OTHER PUBLICATIONS

PCT International Search Report, International Application No. PCT/GB 02/01315, dated Jun. 28, 2002.

(Continued)

*Primary Examiner*—Hoang Dang
(74) *Attorney, Agent, or Firm*—Patterson & Sheridan, LLP

(57) ABSTRACT

A method of forming a seal between two tubular members comprising providing a first tubular member having an internal surface and an external surface describing a first diameter, with a recess in the external surface at a seal portion of the first tubular member. A deformable circumferentially extending sealing member is located in the recess, the sealing member describes an external diameter no greater than the first diameter. The first tubular member is located within a second tubular member and the seal portion of the first tubular member is expanded such that the sealing member engages an inner surface of the second tubular member.

29 Claims, 11 Drawing Sheets

U.S. PATENT DOCUMENTS

| | | | | | |
|---|---|---|---|---|---|
| 2,499,630 | A | | 3/1950 | Clark | |
| 2,627,891 | A | | 2/1953 | Clark | |
| 2,663,073 | A | | 12/1953 | Bieber et al. | |
| 2,754,577 | A | * | 7/1956 | Maxwell | 29/523 |
| 2,898,971 | A | | 8/1959 | Hempel | |
| 3,087,546 | A | | 4/1963 | Woolley | |
| 3,097,696 | A | * | 7/1963 | Orr | 166/135 |
| 3,195,646 | A | | 7/1965 | Brown | |
| 3,467,180 | A | | 9/1969 | Pensotti | |
| 3,785,193 | A | | 1/1974 | Kinley et al. | |
| 3,818,734 | A | | 6/1974 | Bateman | |
| 3,911,707 | A | | 10/1975 | Minakov et al. | |
| 3,997,193 | A | * | 12/1976 | Tsuda et al. | 285/47 |
| 4,069,573 | A | | 1/1978 | Rogers et al. | |
| 4,127,168 | A | | 11/1978 | Hanson et al. | |
| 4,159,564 | A | | 7/1979 | Cooper | |
| 4,288,082 | A | | 9/1981 | Setterberg | |
| 4,324,407 | A | | 4/1982 | Upham et al. | |
| 4,371,199 | A | | 2/1983 | Kushner et al. | |
| 4,429,620 | A | | 2/1984 | Burkhardt et al. | |
| 4,502,308 | A | | 3/1985 | Kelly | |
| 4,531,581 | A | | 7/1985 | Pringle et al. | |
| 4,588,030 | A | | 5/1986 | Blizzard | |
| 4,697,640 | A | | 10/1987 | Szarka | |
| 4,848,469 | A | | 7/1989 | Baugh et al. | |
| 5,083,608 | A | | 1/1992 | Abdrakhmanov et al. | |
| 5,271,472 | A | | 12/1993 | Leturno | |
| 5,322,127 | A | | 6/1994 | McNair et al. | |
| 5,409,059 | A | | 4/1995 | McHardy | |
| 5,435,400 | A | | 7/1995 | Smith | |
| 5,472,057 | A | | 12/1995 | Winfree | |
| 5,494,106 | A | | 2/1996 | Gueguen et al. | |
| 5,560,426 | A | | 10/1996 | Trahan et al. | |
| 5,685,369 | A | | 11/1997 | Ellis et al. | |
| 5,901,787 | A | | 5/1999 | Boyle | |
| 6,021,850 | A | | 2/2000 | Wood et al. | |
| 6,098,717 | A | | 8/2000 | Bailey et al. | |
| 6,135,208 | A | | 10/2000 | Gano et al. | |
| 6,189,616 | B1 | | 2/2001 | Gano et al. | |
| 6,325,148 | B1 | | 12/2001 | Trahan et al. | |
| 6,425,444 | B1 | | 7/2002 | Metcalfe et al. | |
| 6,446,323 | B1 | | 9/2002 | Metcalfe et al. | |
| 6,446,717 | B1 | * | 9/2002 | White et al. | 166/187 |
| 6,457,532 | B1 | | 10/2002 | Simpson | |
| 6,513,600 | B2 | * | 2/2003 | Ross | 166/387 |
| 6,527,049 | B2 | | 3/2003 | Metcalfe et al. | |
| 6,543,552 | B1 | | 4/2003 | Metcalfe et al. | |
| 6,564,870 | B1 | | 5/2003 | Grigsby et al. | |
| 6,702,029 | B2 | | 3/2004 | Metcalfe et al. | |
| 6,702,030 | B2 | | 3/2004 | Simpson | |
| 6,789,622 | B1 | * | 9/2004 | Ducasse et al. | 166/277 |
| 6,959,759 | B2 | * | 11/2005 | Doane et al. | 166/134 |
| 7,096,938 | B2 | * | 8/2006 | Carmody et al. | 166/134 |
| 2002/0166668 | A1 | | 11/2002 | Metcalfe | |

FOREIGN PATENT DOCUMENTS

| | | |
|---|---|---|
| GB | 2345935 | 7/1998 |
| GB | 2346632 | 11/1999 |
| GB | 2345308 | 7/2000 |
| WO | WO 01/18353 | 3/2001 |
| WO | WO 01/33037 | 10/2001 |

OTHER PUBLICATIONS

GB Search Report, GB Application No. 0106820.4, dated Aug. 15, 2001.

* cited by examiner

TUBING SEAL

CROSS-REFERENCE TO RELATED APPLICATIONS

This application is a continuation-in-part of U.S. patent application Ser. No. 10/102,543, filed on Mar. 20, 2002 now abandoned, which claims benefit priority of Great Britain Application No. 0106820.4, filed on Mar. 20, 2001 and this application is also a continuation-in-part of U.S. patent application Ser. No. 10/750,208, filed on Dec. 31, 2003, now U.S. Pat. No. 7,124,826 which claims benefit of U.S. patent application Ser. No. 10/217,833, filed on Aug. 13, 2002, now U.S. Pat. No. 6,702,030, which claims benefit of U.S. patent application Ser. No. 09/469,690, filed on Dec. 22, 1999, now U.S. Pat. No. 6,457,532 which claims benefit of United Kingdom application serial number 9828234.6, filed Dec. 22, 1998, United Kingdom application serial number 9900835.1, filed Jan. 15, 1999; United Kingdom application serial number 9923783.6, filed Oct. 8, 1999 and United Kingdom application serial number 9924189.5, filed Oct. 13, 1999. Each of the aforementioned related patent applications is herein incorporated by reference.

BACKGROUND OF THE INVENTION

1. Field of the Invention

Aspects of this invention relate to a tubing seal, and in particular to a method and arrangement for producing a seal between two tubing sections. Other aspects of the invention relate to a tubing anchor, and to a method and arrangement for anchoring one tubing section relative to another. The different aspects of the invention have particular utility in downhole applications.

2. Description of the Related Art

In many instances it is desired to provide a seal between two overlapping tubing sections in a downhole environment. Where space permits, the seals may be formed of elastomeric packer elements or perhaps as metal-to-metal seals which are energised by spring packs or the like. However, in many applications there will not be sufficient space to accommodate such a sealing arrangement, for example in thin-wall tubing, and in such cases the seals are more often provided in the form of O-ring or chevron sealing members. It has also been proposed to create seals around expandable tubing using sealing members in the form of bands of relatively soft metal, as described in PCT/GB99/04365. In such cases, in order to create an effective seal, it is necessary for the sealing member to extend beyond the surface of the tubing. This makes the seal vulnerable to damage and dislodgement as the tubing is run into the bore.

It is among the objectives of aspects of the present invention to provide a method of forming a seal which obviates or mitigates these and other disadvantages of the prior art.

In other instances it is desired to anchor or secure one tubing section or tool relative to another. This is often achieved by means of slips, typically fingers or keys having a serrated or grooved outer face which co-operate with wedges or cams to push the slips radially outwards to engage with surrounding casing. However, such slips, and the associated slip energising or setting arrangement, occupy a relatively large volume. As described in applicant's International (PCT) Application No. PCT/GB9904365, it has been proposed to overcome this difficulty in some situations by providing a hanger arrangement in which inner tubing carrying small hard elements on its outer surface is expanded into engagement with surrounding tubing. However, the gripping elements are exposed to damage as the inner tubing is run into the bore and may, for example, be scraped from the tubing by contact with a ledge or other restriction. Also, the relatively hard elements may score or scrape the relatively soft material of the existing casing, or bore restrictions such as valve seats, as the tubing is run in.

It is among the objects of other aspects of the invention to provide an anchoring arrangement which obviates or mitigates these disadvantages.

SUMMARY OF THE INVENTION

According to a first aspect of the present invention there is provided a method of forming a seal between two tubular members, the method comprising:

- providing a first tubular member having an internal surface and an external surface, the external surface describing a first diameter;
- providing at least one recess in said external surface at a seal portion of the first tubular member while retaining the wall thickness of the tubular member;
- locating a deformable sealing member in the recess such that the sealing member describes an external diameter no greater than said first diameter;
- locating the first tubular member within a second tubular member; and
- expanding at least the seal portion of the first tubular member such that the sealing member engages an inner surface of the second tubular member.

According to another aspect of the present invention there is provided a seal-forming arrangement comprising:

- a first tubular member having an internal surface, and an external surface describing a first diameter, the tubular member defining at least one recess in said external surface at a deformable seal portion of the first tubular member, said seal portion having a wall thickness substantially equal to the wall thickness of the tubular member adjacent said seal portion; and
- a deformable sealing member in the recess, the sealing member describing an external diameter no greater than said first diameter, wherein expansion of at least the seal portion of the first tubular member increases the diameter of the sealing member to at least said first diameter.

Preferably, the sealing member initially describes a diameter less than said first diameter, that is the outer surface of the sealing member is recessed from the exterior of the tubular member.

According to another aspect of the present invention there is provided a method of forming a seal between two tubular members, the method comprising:

- providing a first tubular member having an internal surface and an external surface describing a first diameter;
- providing at least one recess in said external surface at a seal portion of the first tubular member;
- locating a deformable circumferentially extending sealing member in the recess and such that the sealing member describes an external diameter no greater than said first diameter;
- locating the first tubular member within a second tubular member; and
- expanding at least the seal portion of the first tubular member such that the sealing member engages an inner surface of the second tubular member.

According to a further aspect of the present invention there is provided a seal-forming arrangement comprising:

a first tubular member having an internal surface, and an external surface of a first diameter, the tubular member defining at least one recess in said external surface at a deformable seal portion of the first tubular member; and a deformable sealing member in the recess, the sealing member describing an external diameter no greater than said first diameter, wherein expansion of at least-the seal portion of the first tubular member increases the diameter of the sealing member to at least said first diameter.

As the sealing member is located within the recess, and does not initially extend beyond the external surface of the first tubular member, the sealing member is protected from damage during handling and running into the second tubular member. This is particularly useful in downhole applications, in which the first tubular member may have to pass through several thousand metres of tubing defining ledges, restrictions and other hazards, before reaching the sealing location.

Where reference is made to a second tubular member, this is intended to encompass any appropriate tubing or bore, including a bore formed in a non-cylindrical object, and a drilled bore in an earth formation.

The recess may take any appropriate form, and preferably will be in the form of an annular -or part-annular depression. Alternatively, adjacent surface portions of the first tubular member may be upset, or may define ribs or other projections to protect the sealing member.

The recess may be formed by one or more of a variety of methods, including: deforming the first tubular member at said seal portion to create a localised reduction in external diameter, which may occur while retaining the wall thickness of the tubular member; or moving or removing material from said seal location to create a region of reduced wall thickness. Alternatively, the tubular member may be cast or otherwise formed with the recess.

The sealing member receiving recess may itself be provided within a larger recess. This provides still further protection for the sealing member; for example, fluid flowing in an annulus between the first and second tubular members will decelerate on encountering the larger recess, and thus there is less likelihood of the sealing member being washed out of the recess.

The sealing member may be formed of any appropriate material, including an elastomer or a metal, which metal may be relatively ductile or, alternatively, may be adapted to experience only elastic deformation in the creation of a sealing contact with the second tubing member.

On expanding the seal portion, the sealing member may be deformed to a lens-shaped cross-section.

Preferably, the seal portion is expanded by rolling expansion, with an expansion member being rotated within the first tubular member with a face in rolling contact with an internal surface thereof. Such expansion creates a hoop stress in the first tubular member, which tends to increase the ability of the member to withstand external compressive or crush forces, including external fluid pressure. Most preferably, the seal portion is deformed by compressive plastic deformation, which may produce a localised reduction in wall thickness and a subsequent increase in diameter.

The first tubular member may be expanded only at or in the area of the seal portion, or an extended portion of the tubular member may be expanded; this may be useful in anchoring the first tubular member in the second tubular member.

Preferably, a plurality of longitudinally spaced-apart circumferential seal members are provided.

Another aspect of the present invention relates to a method of forming a coupling or anchor between two tubular members, the method comprising:

providing a first tubular member having an internal surface and an external surface describing a first diameter;

providing at least one recess in said external surface at an anchor portion of the first tubular member;

locating an anchoring member in the recess, the anchoring member describing an external diameter no greater than said first diameter;

locating the first tubular member within a second tubular member; and expanding at least the anchor portion of the first tubular member such that the anchoring member engages an inner surface of the second tubular member.

According to another aspect of the present invention there is provided an anchor-forming arrangement comprising:

a first tubular member having an internal surface, and an external surface of a first diameter, the tubular member defining at least one recess in said external surface at a deformable anchor portion of the first tubular member; and an anchoring member in the recess, the anchoring member describing an external diameter no greater than said first diameter, wherein expansion of at least the anchor portion of the first tubular member increases the diameter of the anchoring member to at least said first diameter.

As the anchoring member is located within the recess, and does not initially extend beyond the external surface of the first tubular member, the anchoring member is protected from damage during handling and running into the second tubular member and will itself not cause damage to the second tubular member.

The anchoring member may be formed of any appropriate material, and typically is formed of a relatively hard material, that is a material harder than the material of the tubular member. The anchoring member may take any appropriate form, and is preferably in the form of a ring, which may be split or otherwise segmented. The member may define serrations or teeth. Alternatively, the anchoring member may be in the form of a volume or area of hard material, or an area of blocks or pieces of relatively hard material.

The anchoring member may be releasable, that is the member may be movable to disengage from an inner surface of the second tubular member. This may be achieved by moving the engaged anchor member relative to the second tubular member to locate the anchor member above a groove or the like, or by otherwise removing support for the anchor member.

The invention also relates to a method of reinforcing a thin-walled tubular member against crush forces, the method comprising:

locating a thin-walled first tubular member within a larger diameter second tubular member; and expanding the first tubular member by rolling expansion to create a hoop stress in the member and to bring an outer surface of the first member into contact with the second member, whereby subsequent collapse of the first member requires circumferential compression of the wall of the first member or deformation of the second member.

This aspect of the invention allows relatively thin walled tubing to be utilised as, for example, a patch or straddle in circumstances where the tubing, before expansion, would not be capable of resisting the external pressure forces which the expanded tubing will experience. This allows use of a thinner wall and thus less expensive tubing, and also facilitates expansion of the tubing.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
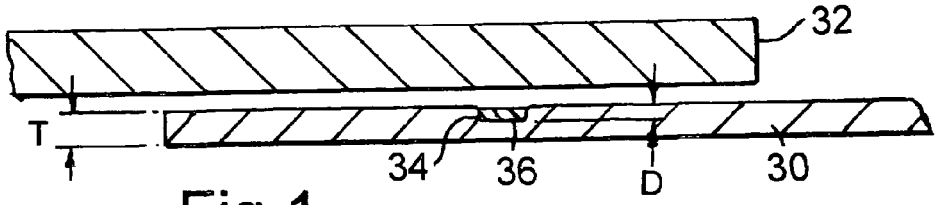
FIG. 1 is a diagrammatic sectional view of portions of the walls of two tubing members of a seal-forming arrangement in accordance with an embodiment of the present invention, prior to expansion of the inner tubing member.

Reference is first made to FIG. 1 of the drawings, which illustrates parts of portions of the walls of first and second tubular members 30, 32 of a seal-forming arrangement in accordance with an embodiment of the present invention. The larger diameter outer second tubing member 32 may be located downhole in the form of, for example, metal bore-lining casing. The inner first tubing member 30 may be part of a packer or the upper end of a section of bore-lining casing or liner which is to be sealed relative to the second tubing member 32, as will be described.

Machined in an outer face of the first tubing member 30 is an annular groove 34, which groove is occupied by a sealing member in the form of an elastomeric sealing ring 36. The outer surface of the sealing ring 36 has a maximum diameter which is less than the adjacent portions of the tubing member 30.

Figure 2:
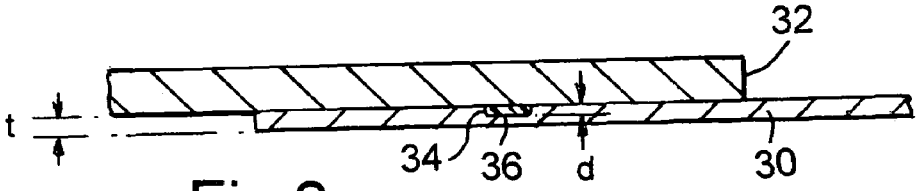
FIG. 2 corresponds to FIG. 1, but shows the tubing walls after expansion of the inner tubing member.

To form a seal between the tubing members 30, 32, the first tubing member 30 is expanded by a rolling expansion process which reduces the thickness of the wall of the first tubing member from T to t, as illustrated in FIG. 2, and further decreases the depth of the groove 34 from D to d. The reduction in depth of the groove 34, which results in the groove 34 being shallower than the sealing ring 36, urges the sealing ring 36 radially outwards relative to the outer surface of the tubing member 30 and into sealing contact with the inner surface of the second tubing member 32.

In another embodiment, a pipe or a casing may include a circumferentially extending and fully recessed elastomeric ring as shown in FIGS. 11A-11B and described in paragraph 0069 of U.S. Patent Publication No. 2003/0019638, which is herein incorporated by reference. In a further embodiment, an elastomeric ring may be flush mounted in a circumferential groove formed in an outer surface of the pipe or the casing as shown in FIGS. 12A-12B and described in paragraph 0070 of U.S. Patent Publication No. 2003/0019638.

Figure 3A:
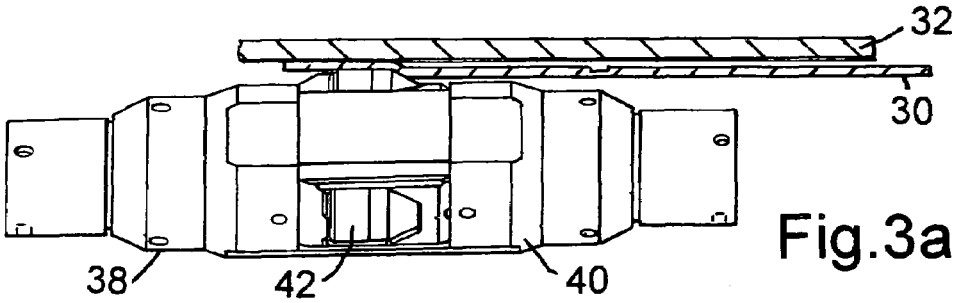
FIGS. 3*a*, 3*b* and 3*c* illustrate steps in the creation of a seal in accordance with an embodiment of the present invention and utilising the seal forming arrangement of FIG. 1.
Figure 3B:
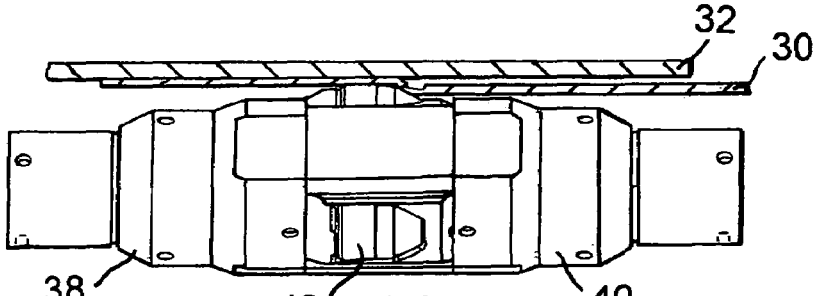
Figure 3C:
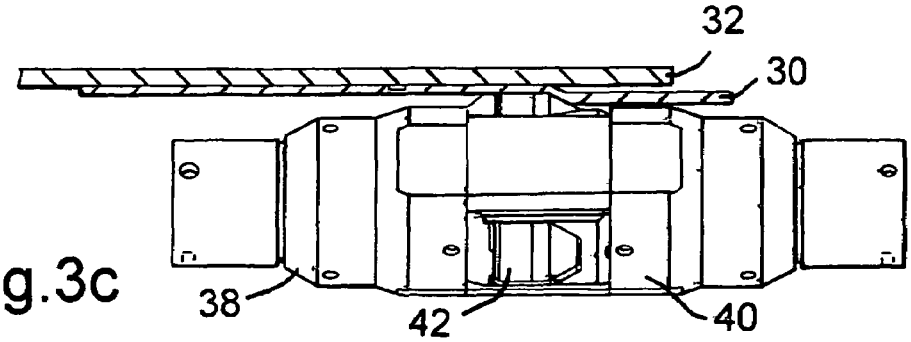

Reference is now made to FIGS. 3*a*, 3*b* and 3*c* of the drawings, which illustrate the expansion of the inner tubing member 30. The Figures illustrate an expansion device 38 including a body 40 carrying three piston-mounted rollers 42. The device 38 is mounted on an appropriate running string (not shown) and by supplying pressurised fluid to the interior of the body 40 the rollers 42 are urged radially outwards and into contact with the inner wall of the first tubing member 30. If the device 38 is rotated and axially advanced, the rollers 42 reduce the wall thickness of the tubing member 30, and thereby increase the diameter of the member 30. Thus, the sealing arrangement as illustrated in FIG. 2 may be formed.

Figure 4:
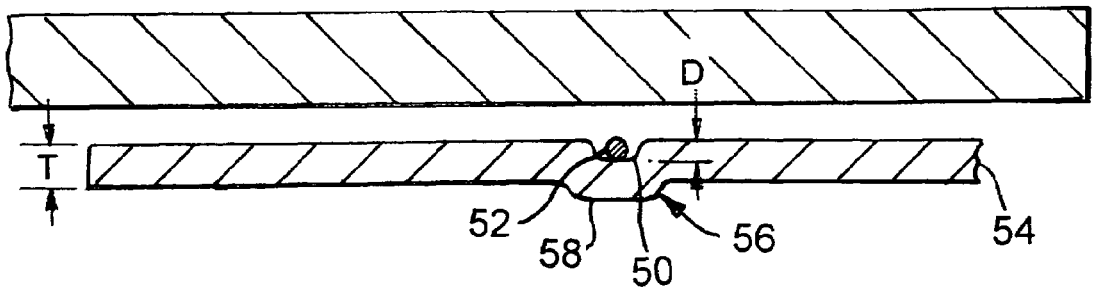
FIGS. 4 and 5, 6 and 7, 8 and 9, 10 and 11, and 12 and 13, are diagrammatic sectional views of portions of the walls of tubing members of seal forming arrangements in accordance with further embodiments of the present invention, shown prior to and following expansion of the inner tubing member, respectively.
Figure 5:
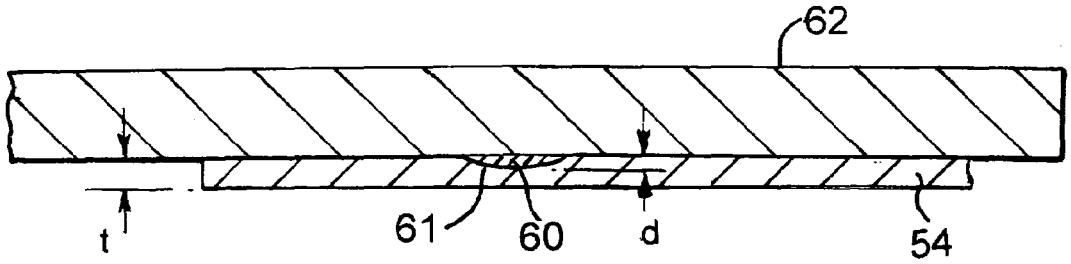

FIGS. 4 and 5 of the drawings illustrate an arrangement in which the groove 50 which receives the sealing ring 52, in the form of an elastomer O-ring, is formed in the first tubing member 54, while retaining the wall thickness at the seal portion 56 of the member 54, in contrast to the reduction in wall thickness which occurs when the groove is machined, as illustrated in FIG. 1 above.

As will be noted from FIG. 4, forming the groove in the tubing member 54 creates an inner shoulder or protrusion 58, however following expansion of the tubing member 54, utilising a similar method as that illustrated in FIGS. 3*a*, 3*b* and 3*c*, the member 54 presents a smooth inner surface. In this example, the sealing ring 52 is illustrated as initially being in the form of an O-ring which, following expansion of the first tubing member 54, is deformed to a lens shape 60, occupying a shallow depression of corresponding shape 61. The configuration of the deformed sealing ring 60 provides for a large contact area with both the outer surface of the first tubing member 54 and the inner surface of the outer second tubing member 62. Further, the area of the deformed seal 60 exposed to pressurised fluid attempting to pass between the tubing members 54, 62 is relatively small, such that the pressure forces acting on the sleeves 60 will also be relatively small.

Figure 6:
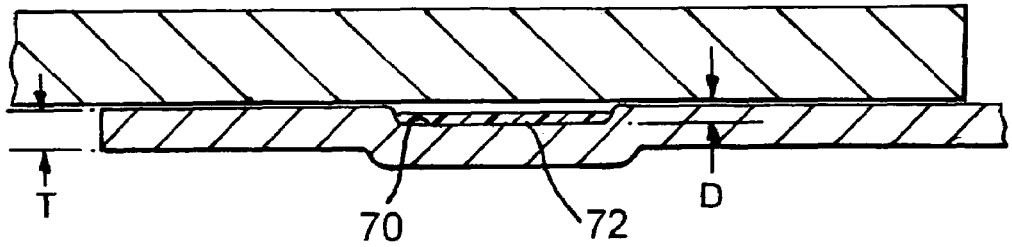
Figure 7:
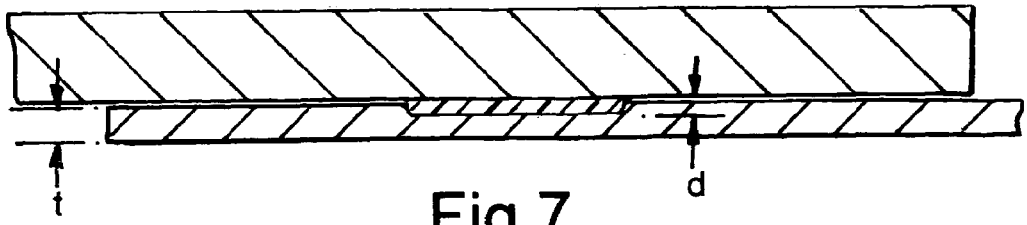

Reference is now made to FIGS. 6 and 7 of the drawings, which show an alternative groove and sealing member configuration, in particular the formed groove 70 being relatively broad, and the sealing member 72 having a corresponding axial extent, and being relatively shallow such that the outer face of the sealing member 72 lies below the outer surface of the first tubing member.

Figure 8:
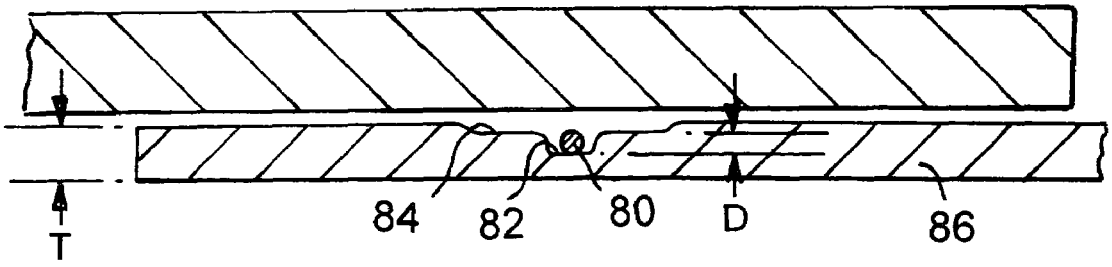
Figure 9:
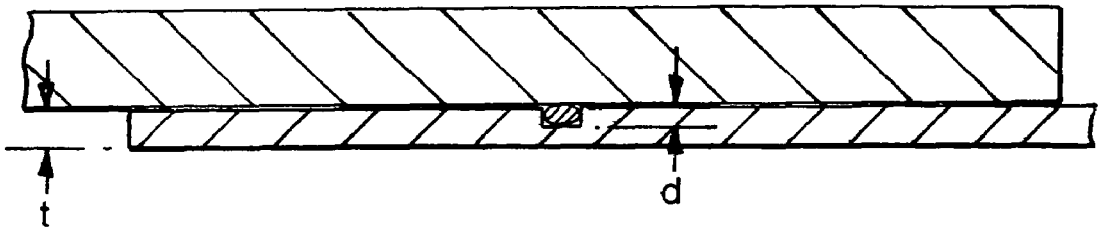

FIGS. 8 and 9 of the drawings illustrate an arrangement in which a sealing member 80 is located in a machined narrow groove 82 itself formed in the middle of a machined broad groove 84, this configuration offering additional protection for the sealing member 80 while the first tubing member 86 is being run into the bore.

Figure 10:
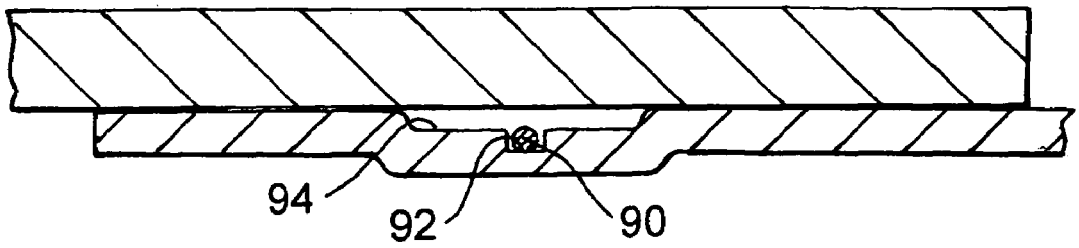
Figure 11:
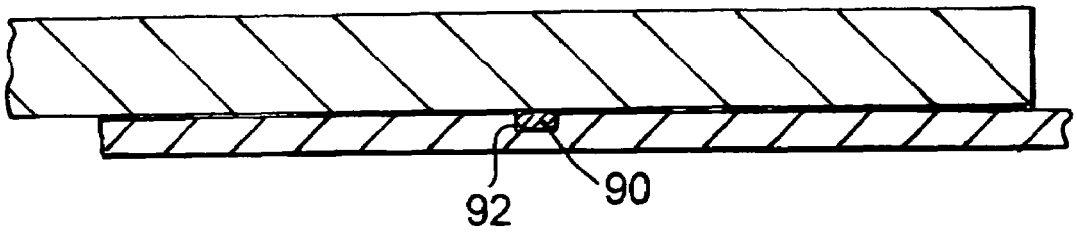

In the arrangement illustrated in FIGS. 10 and 11, a sealing member 90 is located in a machined narrow groove 92 itself located centrally within a relatively broad formed groove 94.

Figure 12:
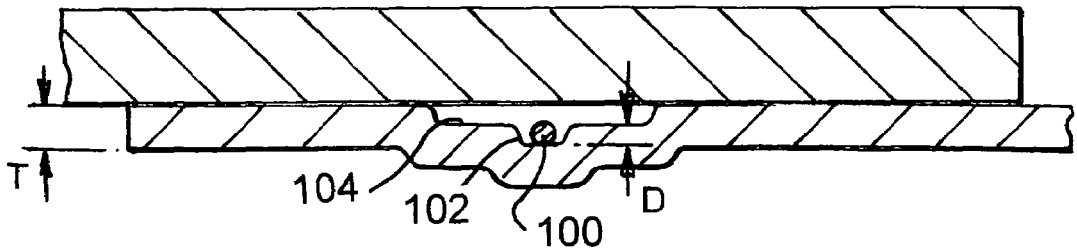
Figure 13:
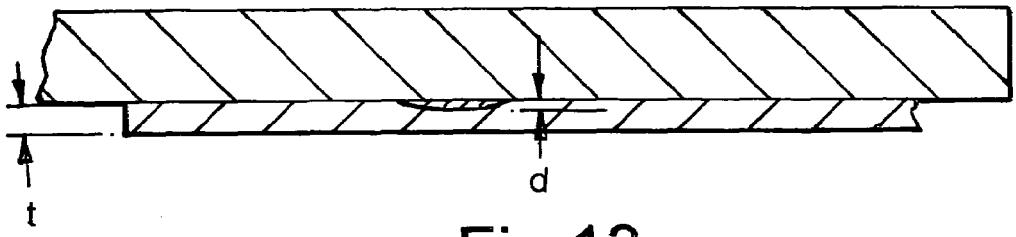

In FIGS. 12 and 13, a sealing member 100 is located in a formed narrow groove 102 itself located centrally within a formed broad groove 104.

It will be noted by comparing the different forms of groove arrangements that the use of formed grooves tends to result in a greater degree of deformation of the sealing member. Thus, the form of the groove and the form of the sealing member may be varied according to the intended application.

Figure 14:
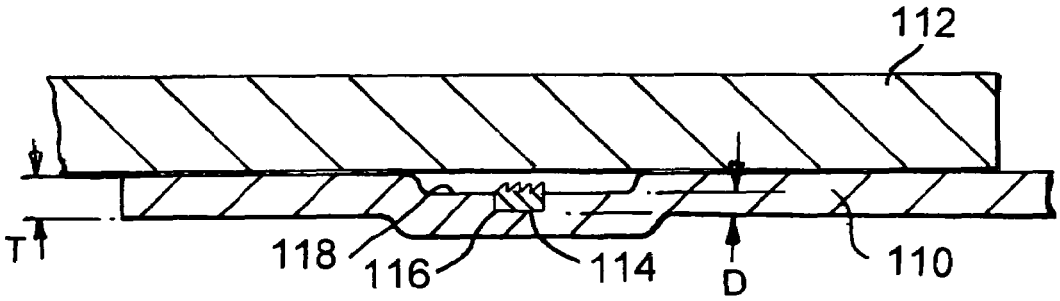
FIG. 14 is a diagrammatic sectional view of portions of the walls of tubing members of a tubing coupling arrangement in accordance with an embodiment of a further aspect of the present invention, prior to expansion of the inner tubing member.
Figure 15:
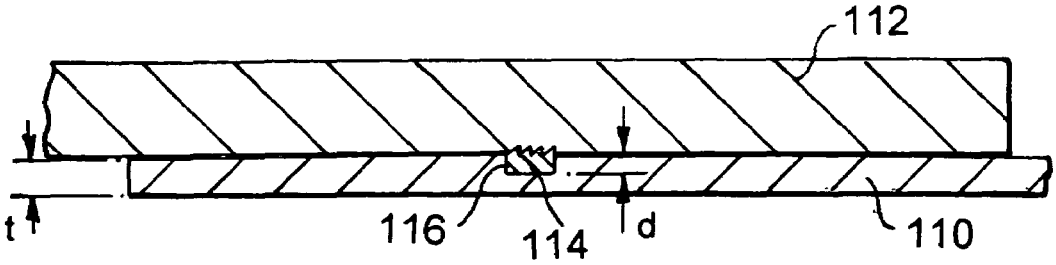
FIG. 15 corresponds to FIG. 14, but shows the tubing walls after expansion of the inner tubing member.

Reference is now made to FIGS. 14 and 15 of the drawings, which illustrate portions of the wall of first and second tubing members 110 and 112 of a coupling arrangement in accordance with an embodiment of the further aspect of the present invention. In this embodiment a ring slip member 114 having a toothed outer face is located in a machined groove 116 located centrally within a relatively broad formed groove 118. As will be described, if the first tubing member 110 is expanded by rolling expansion, the thickness of the first tubing member 110 is reduced from T to t, with a corresponding increases in diameter, the formed groove 118 is "removed", and the depth of the machined groove 116 relative to the adjacent outer surface of the first tubing member 110 is reduced from D to d.

Figure 16A:
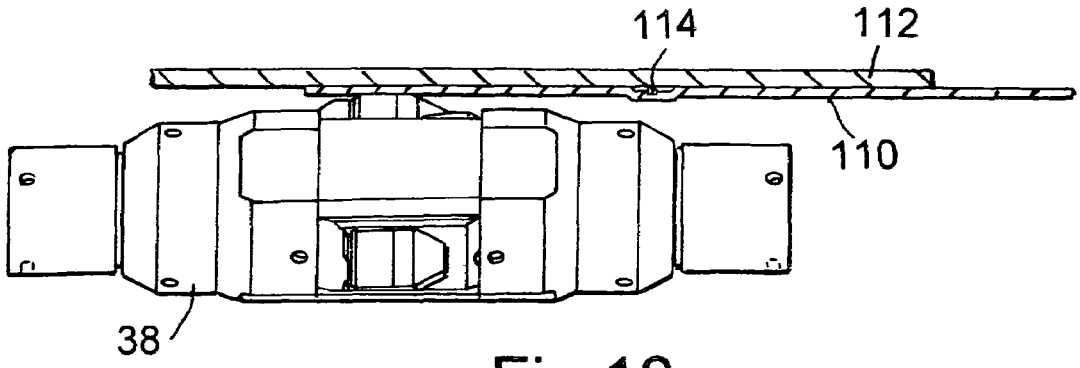
FIGS. 16*a*, 16*b* and 16*c* illustrate the expansion of the inner tubing member of FIG. 14.
Figure 16B:
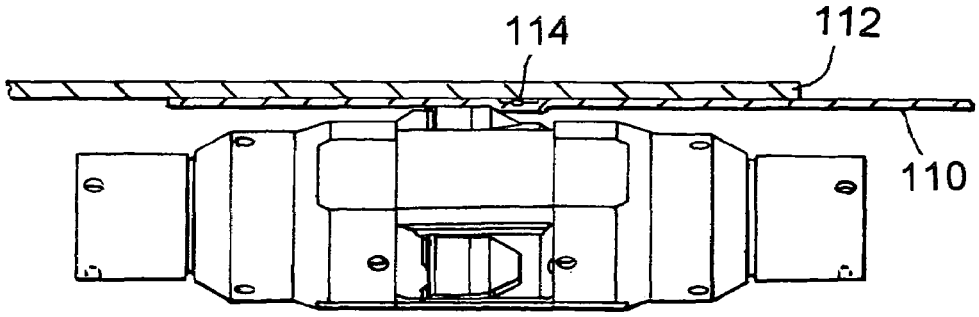
Figure 16C:
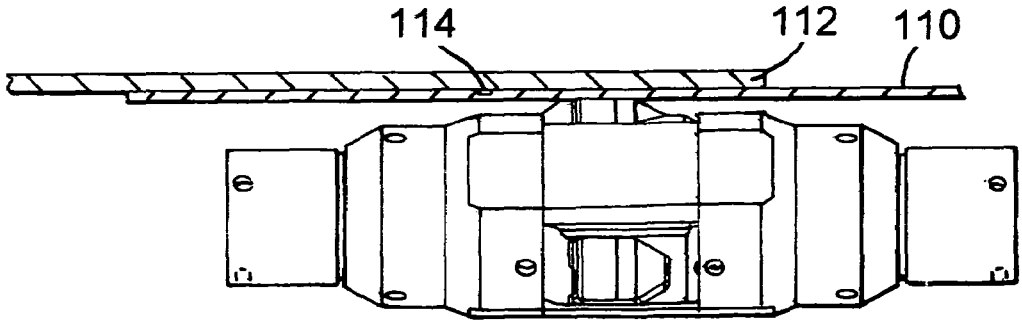

One example of the expansion process is illustrated in FIG. 16, and utilises an expansion device 38 similar to the device described above with reference FIGS. 3*a*, 3*b* and 3*c*. The expansion process is illustrated in 16*a*, 16*b* and 16*c*, and involves rotation and axial advancement of the energised expansion device 38. Following expansion of the first tubing member 110, the teeth on the outer surface of the ring slip member 114 engage the inner face of the second tubing member 112, as illustrated in FIG. 15.

Figure 17A:
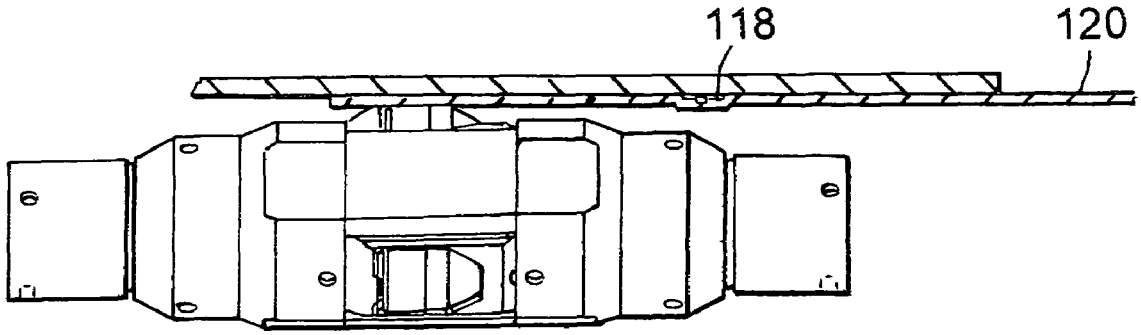
FIGS. 17*a*, 17*b* and 17*c* illustrate an alternative expansion process for the inner tubing member of FIG. 14.
Figure 17B:
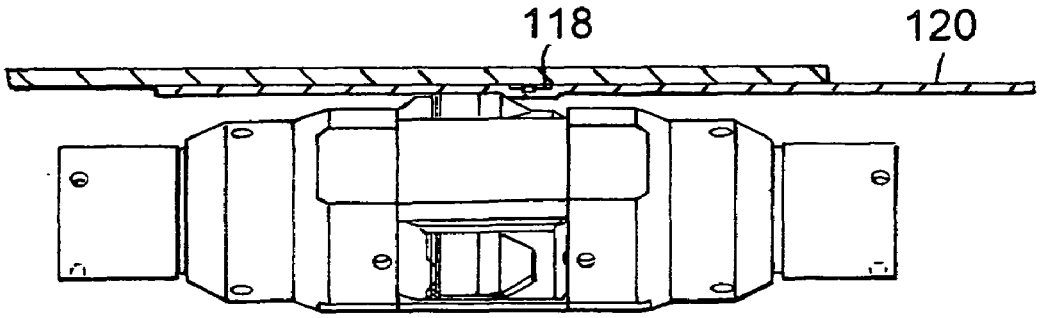
Figure 17C:
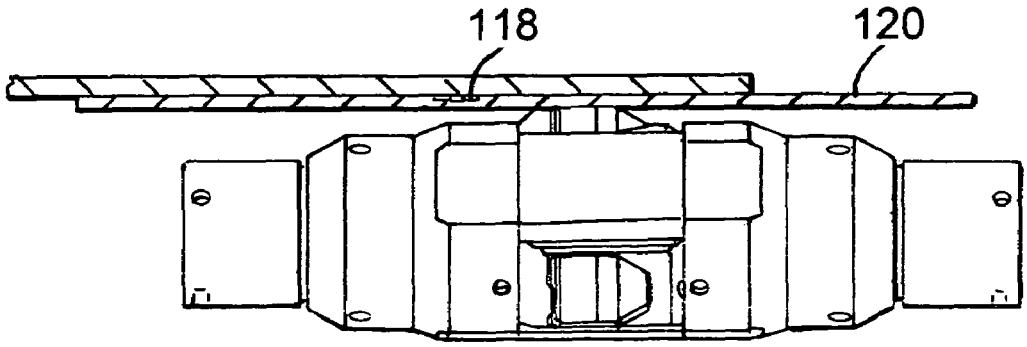

A slightly different expansion operation is illustrated in FIGS. 17*a*, 17*b* and 17*c* of the drawings; however, in this case the degree of expansion is selected such that the broad formed groove 118 is retained in the expanded first tubing member 120, although the groove 122 is of decreased depth with respect to the original groove in the unexpanded member.

Figure 18:
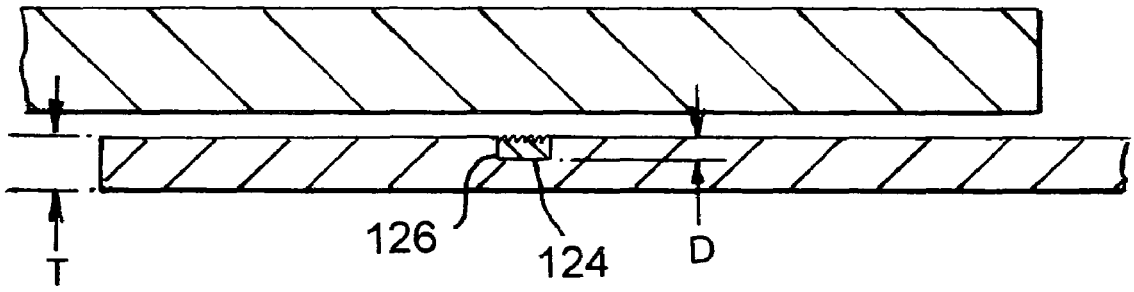
FIGS. 18 and 19 are diagrammatic sectional views of portions of the walls of tubing members of a tubing coupling arrangement in accordance with another embodiment of the present invention, shown prior to and following expansion of the inner tubing member, respectively.
Figure 19:
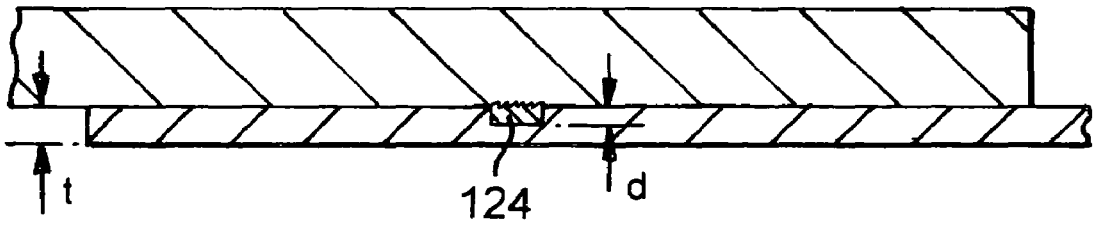
Figure 20:
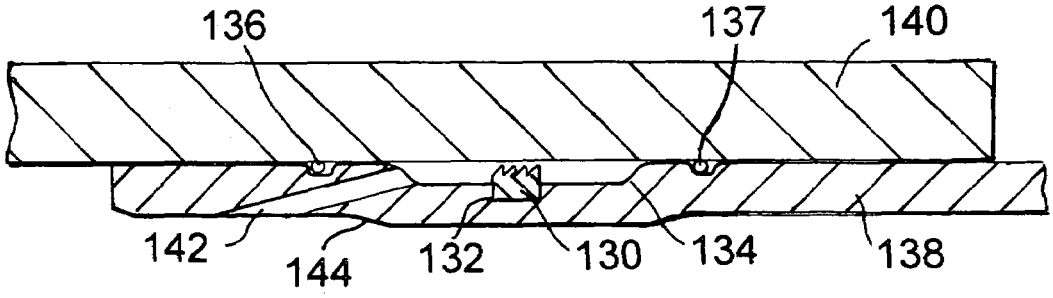
FIG. 20 is a diagrammatic sectional view of portions of the walls of two tubing members of a coupling arrangement in accordance with a still further embodiment of the present invention, prior to expansion of the inner tubing member.

FIGS. 18 and 19 illustrate an alternative anchoring or coupling arrangement, in which a ring slip member 124 is located in a relatively narrow machined groove 126.

Reference is now made to FIGS. 20, 21 and 22*a* and 22*b*, which show a further alternative arrangement in which a ring slip member 130 is located in a narrow machined groove 132 positioned centrally within a broader formed groove 134. In addition, substantially conventional O-ring seals 136, 137 are located above and below the groove 134 and provide a seal between the outer surface of the first tubing member 138 and the inner surface of the second tubing member 140. Also, a fluid communicating passage 142 extends between the internal bore of the first tubing member 138 and the groove 134.

Figure 21:
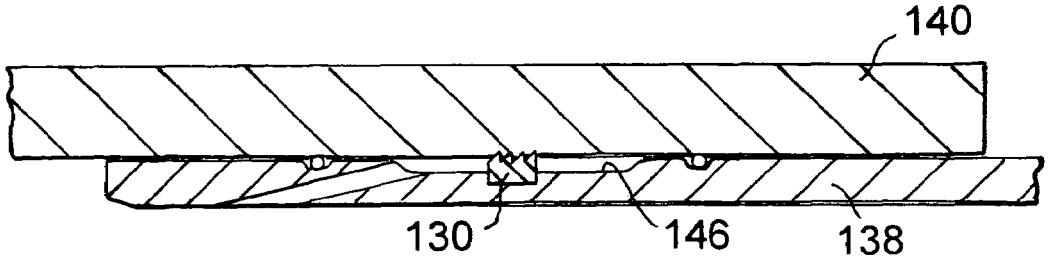
FIG. 21 corresponds to FIG. 20, but shows the tubing walls after expansion of the inner tubing member.

To engage the ring slip member 130 with the second tubing member 140, and lock the first tubing member 138 relative the second tubing member 140, an expander is passed through the first tubing member 138 to "take out" the protrusion 144 created in forming the groove 134. After expansion, and as illustrated in FIG. 21, a slightly shallower groove 146 is retained in the expanded tubing.

Figure 22A:
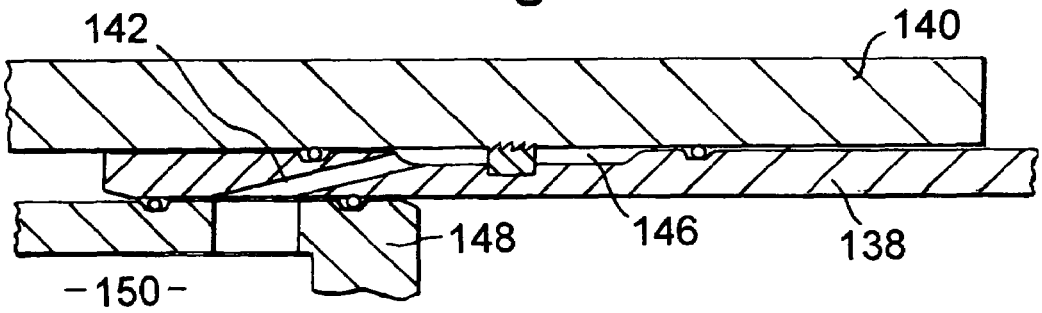
FIGS. 22*a* and 22*b* show steps in the creation of the coupling arrangement of FIG. 21.
Figure 22B:
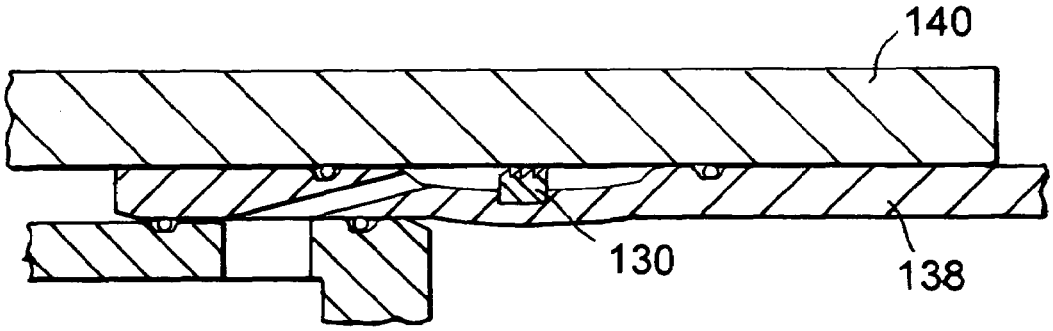

To subsequently release the first tubing member 138 from the second tubing member 140, a tool 148 is run into the bore to provide fluid communications between the tool interior 150 and the fluid port 142, as illustrated in FIG. 22*a*. If pressurised fluid is then supplied through the tool 148 and into the groove 146, the tubing wall around the ring slip member 130 may be plastically deformed to such an extent that the ring slip member 130 is moved radially inwards, out of engagement with the inner surface of the second tubing member 140, as illustrated in FIG. 22*b*.

Figure 23:
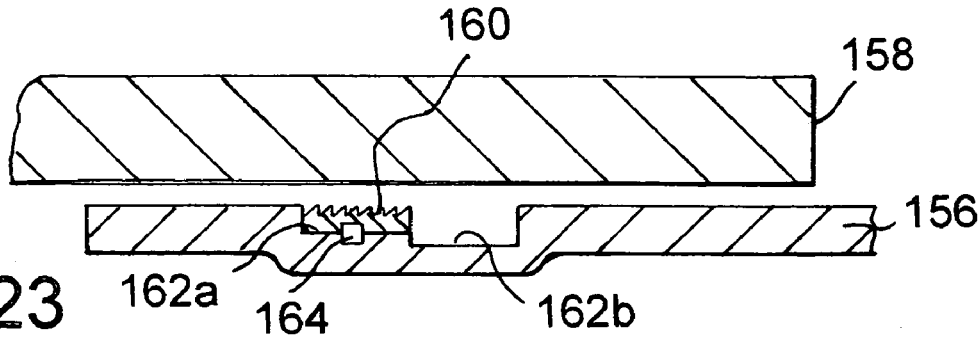
FIG. 23 is a diagrammatic sectional view of portions of the walls of two tubing members of a coupling arrangement in accordance with another embodiment of the present invention, prior to expansion of the inner tubing member.
Figure 24:
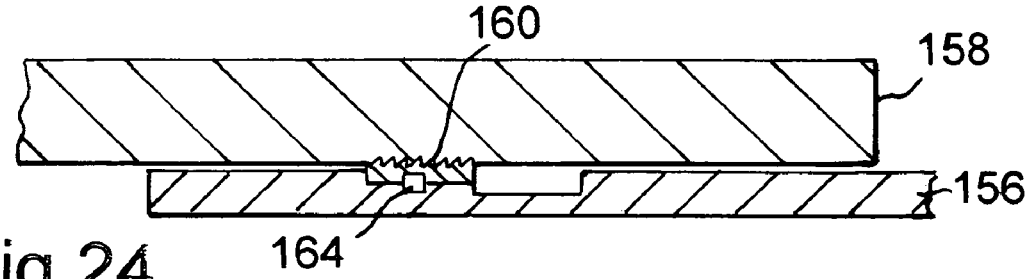
FIG. 24 corresponds to FIG. 23, but shows the tubing walls after expansion of the inner tubing member.
Figure 25A:
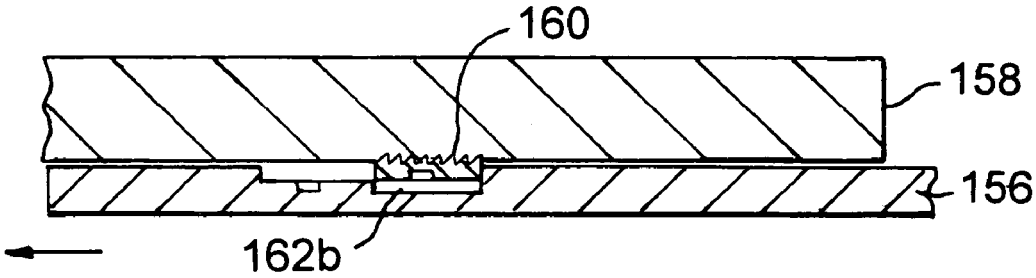
FIGS. 25*a* and 25*b* show steps in the release of the coupling arrangement of FIG. 24.
Figure 25B:
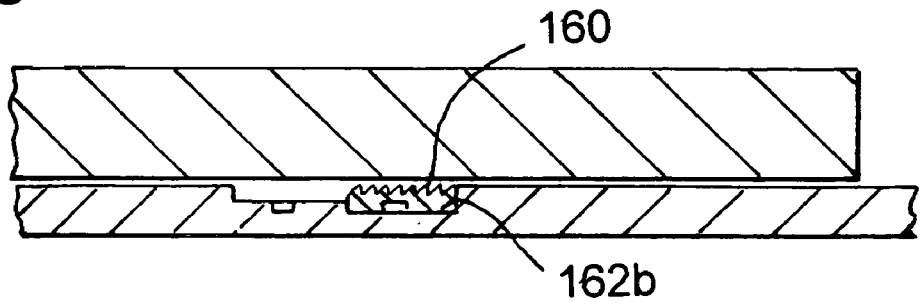

Reference is now made to FIGS. 23, 24 and 25 of the drawings, which are a diagrammatic sectional views of portions of the walls of two tubing members 156, 158 of a coupling arrangement in accordance with another embodiment of the present invention. In this embodiment, a ring slip member 160 is located in a machined groove 162 in the inner tubing member 156, the groove having a shallow portion 162*a* and a deeper portion 162*b*. The slip member 160 is initially located in the shallow groove portion 162*a*, and is retained there by a shear pin 164.

The ring slip member 160 is engaged with the outer tubing 158, to lock the tubing members 156, 158 together, in a similar manner to the above described embodiments, that is by passing an expander through the inner tubing member 156. The ring slip 160 may or may not be split, however during the locking process the slip member 160 is not deformed completely past the yield point of the material; this provides a restoring force to facilitate release of the member 160, as described below.

To release the inner tubing member 156, an upwards force is applied to the inner tubing member 156, which force may be applied mechanically or hydraulically. The release force must be sufficient to shear the pin 164, allowing the tubing 156 to move upwards relative to the outer tubing 158 and the slip member 160, which is of course locked relative to the tubing 158. This relative movement positions the slip member 160 in the deeper portion of the groove 162*b* (FIG. 25*a*), and subsequent movement of the tubing 156, combined with the restoring force within the elastically deformed member 160, moves the slip member radially inwardly and into the deeper slot portion 162*b* (FIG. 25*b*), thus releasing the tubing 156 such that it may be withdrawn or otherwise moved in the bore.

Figure 26:
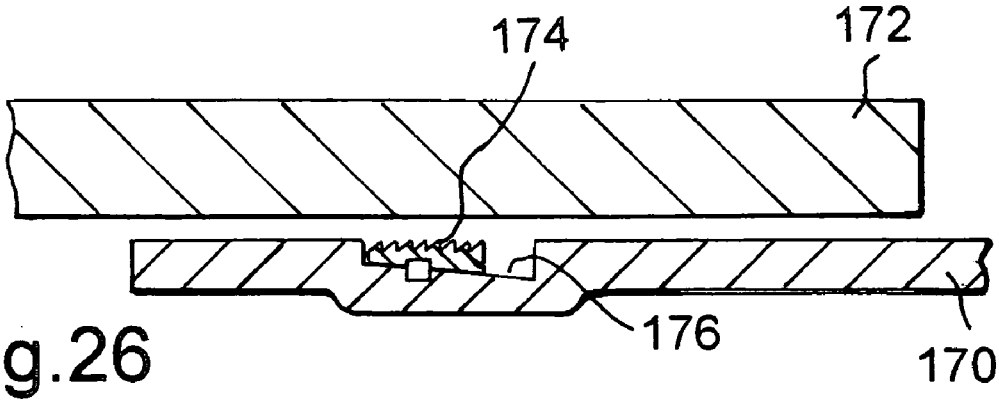
FIG. 26 is a diagrammatic sectional view of portions of the walls of two tubing members of a coupling arrangement in accordance with yet another embodiment of the present invention, prior to expansion of the inner tubing member.
Figure 27:
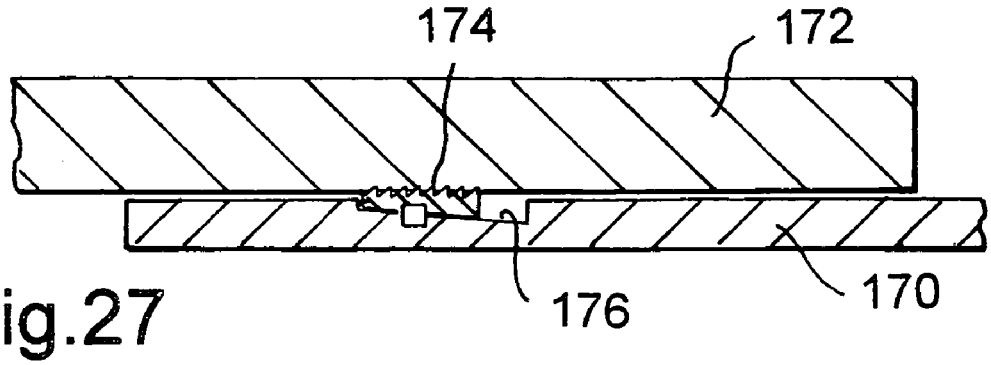
FIG. 27 corresponds to FIG. 26, but shows the tubing walls after expansion of the inner tubing member.
Figure 28A:
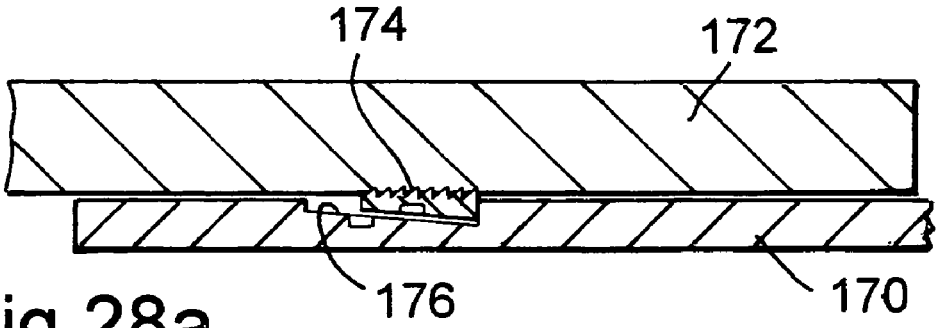
FIGS. 28*a* and 28*b* show steps in the release of the coupling arrangement of FIG. 27.
Figure 28B:
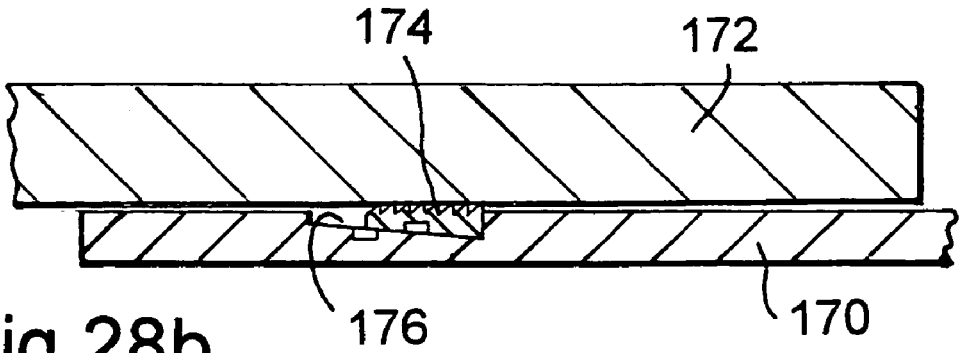

Reference is now made to FIGS. 26 to 28 of the drawings, which are diagrammatic sectional views of portions of the walls of two tubing members 170, 172 of another releasable coupling arrangement. The arrangement differs from that of FIGS. 23 to 25 in that the ring slip member 174 features a tapering profile, as does the machined groove 176 in which the slip member 174 is located. The setting and release procedures are the same as for the embodiment of FIGS. 23 to 25, however load is supported against the interference of the slip member 174 compressively on the tapered groove profile, as opposed to on the upper face or flank of the slip member.

Figure 29:
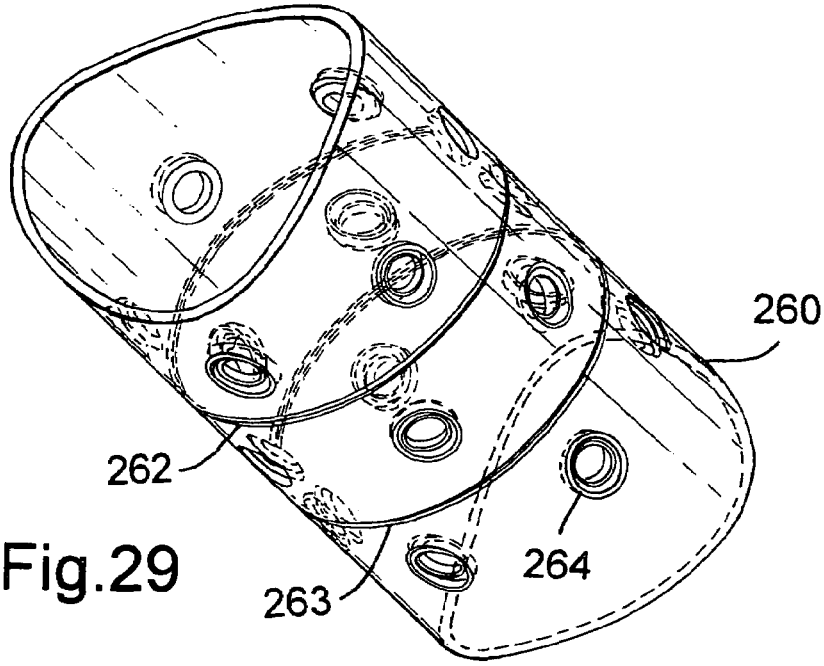
FIGS. 29, 30 and 31 are perspective, side and sectional views of an inner tubing member of a coupling arrangement in accordance with a still further embodiment of the present invention.
Figure 30:
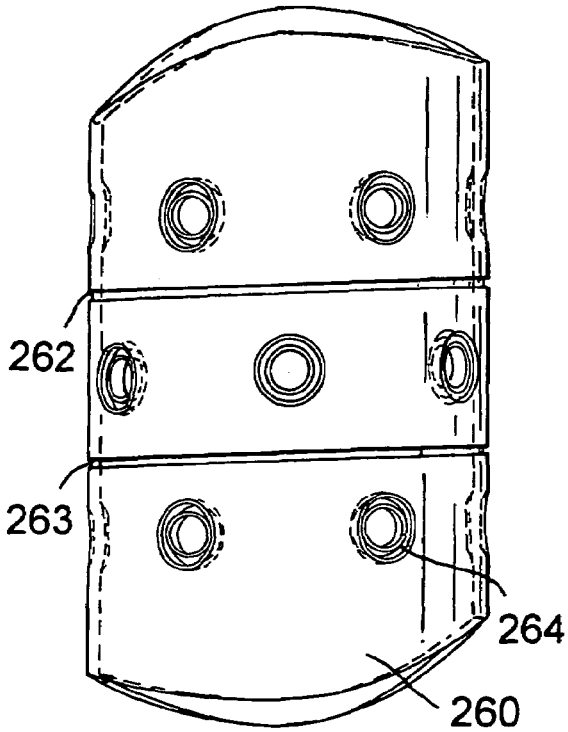
Figure 31:
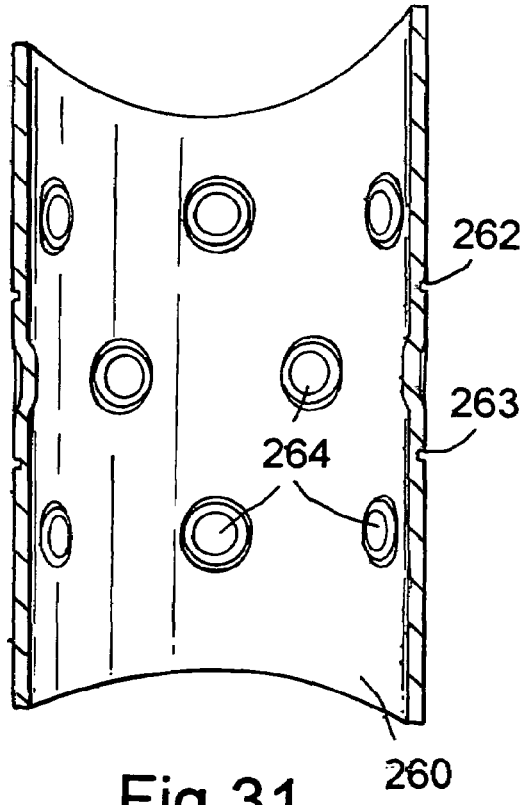

Reference is now made to FIGS. 29, 30 and 31, which illustrate tubing 260 forming part of a hanger system in accordance with an embodiment of the invention. The tubing 260 defines two circumferential grooves 262, 263 which accommodate resilient sealing members (not shown). Further, the tubing 260 defines a number of formed recesses which accommodate generally circular slip areas 264 formed of small blocks of relatively hard material held in a softer matrix.

When the tubing 260 is located within a larger diameter tubing (not shown), and expanded as described above, the sealing members in the grooves 262, 263 form seals with the outer tubing, and the blocks of material in the slip areas 264 key into this surrounding larger diameter tubing. Thus, the expanded tubing 260 is sealed and anchored within the larger diameter tubing.

It will be apparent to those of skill in the art that the above-described embodiments provide relatively simple yet effective means for sealing and anchoring a thin wall tubing member within a larger diameter tubing. Further, the provision of one or both of an anchor and a seal may be achieved without any significant loss of diameter, and the arrangement of seals and slip members is such that the seals and slip members are protected from damage while running in and are thus more likely to provide an effective sealing and anchoring arrangement.

It will further be apparent to those of skill in the art that the above-described embodiments are merely exemplary of the present invention, and that various modifications may be made thereto without departing from the present invention. For example, the invention is not limited to use in thin wall tubing, and may be utilised in any deformable tubing. Further, the deformable tubing may form part of a larger tubing member which is otherwise non-deformable, or not intended for deformation.

The invention claimed is:

1. A method of forming a coupling between tubular members, the method comprising:

providing a first tubular member having an internal surface and an external surface, wherein the first tubular includes an anchor portion comprising at least one recess in the external surface and an anchoring ring member;

locating the first tubular member within a second tubular member;

expanding a circumferential portion of the first tubular member such that the anchoring ring member engages an inner surface of the second tubular member; and releasing the anchoring ring member from engagement with the inner surface of the second tubular member.

2. A method of forming a coupling between tubular members, the method comprising:

providing a first tubular member having an internal surface and an external surface, wherein the first tubular includes a seal portion comprising at least one recess in the external surface and an anchoring member;

locating the first tubular member within a second tubular member;

expanding at least the seal portion of the first tubular member such that the anchoring member engages an inner surface of the second tubular member;

positioning a tool proximate the seal portion such that a port in the tool aligns with a fluid port in the seal portion of the first tubular; and releasing the anchoring member from engagement with the inner surface of the second tubular member.

3. The method of claim 2, further including pumping fluid through the fluid port and into the at least one recess.

4. The method of claim 3, wherein the fluid causes the anchoring member to move radially inward, thereby releasing the anchoring member from engagement with the second tubular member.

5. A method of forming a coupling between tubular members, the method comprising:

providing a first tubular member having an internal surface and an external surface, wherein the first tubular includes a seal portion comprising at least one recess and a second deeper recess in the external surface and an anchoring member, wherein the anchoring member is secured in the at least one recess with a shearable connection;

locating the first tubular member within a second tubular member;

expanding at least the seal portion of the first tubular member such that the anchoring member engages an inner surface of the second tubular member; and releasing the anchoring member from engagement with the inner surface of the second tubular member.

6. The method of claim 5, further including applying a force to the first tubular member to shear the shearable connection and cause the anchoring member to move from the at least one recess to the second deeper recess.

7. The method of claim 6, wherein the anchoring member moves radially inward when the anchoring member is in the second deeper recess, thereby releasing the anchoring member from engagement with the second tubular member.

8. A method of forming a coupling between tubular members, the method comprising:

providing a first tubular member having an internal surface and an external surface, wherein the first tubular includes a seal portion comprising at least one recess in the external surface and an anchoring member, wherein the anchoring member is secured in the at least one recess with a shearable connection and the at least one recess includes a tapered profile;

locating the first tubular member within a second tubular member;

expanding at least the seal portion of the first tubular member such that the anchoring member engages an inner surface of the second tubular member; and releasing the anchoring member from engagement with the inner surface of the second tubular member.

9. The method of claim 8, further including applying a force to the first tubular member to shear the shearable connection and cause the anchoring member to move along the tapered profile of the at least one recess.

10. The method of claim 9, wherein movement along the tapered profile causes the anchoring member to move radially inward, thereby releasing the anchoring member from engagement with the second tubular member.

11. A method of forming a coupling or anchor between two tubular members, the method comprising:

providing a first tubular member having an internal surface and an external surface describing a first diameter, wherein the first tubular includes at least one recess in the external surface at a seal portion;

locating an anchoring member in the recess, the anchoring member describing an external diameter no greater than the first diameter;

locating the first tubular member within a second tubular member;

expanding at least the seal portion of the first tubular member such that the anchoring member engages an inner surface of the second tubular member; and releasing the anchoring member from engagement with the inner surface of the second tubular member.

12. The method of claim 11, wherein the first tubular includes a second deeper recess in the external surface and the anchoring member is secured in the at least one recess with a shearable connection.

13. The method of claim 12, further including applying a force to the first tubular member to shear the shearable connection and cause the anchoring member to move from the at least one recess to the second deeper recess.

14. The method of claim 13, wherein the anchoring member moves radially inward when the anchoring member is in the second deeper recess, thereby releasing the anchoring member from engagement with the second tubular member.

15. A method of forming a coupling between tubular members, the method comprising:

providing a first tubular member having an internal surface and an external surface, wherein the first tubular includes an anchor portion comprising at least one recess in the external surface and an anchoring member;

locating the first tubular member within a second tubular member;

expanding at least the anchor portion of the first tubular member such that the anchoring member engages an inner surface of the second tubular member;

positioning a tool proximate the anchor portion such that a port in the tool aligns with a fluid port in the anchor portion of the first tubular; and releasing the anchoring member from engagement with the inner surface of the second tubular member.

16. The method of claim 15, further including pumping fluid through the fluid port and into the at least one recess.

17. The method of claim 16, wherein the fluid causes the anchoring member to move radially inward, thereby releasing the anchoring member from engagement with the second tubular member.

18. A method of forming a coupling between tubular members, the method comprising:

providing a first tubular member having an internal surface and an external surface, wherein the first tubular includes an anchor portion comprising at least one recess and a second deeper recess in the external surface and an anchoring member, wherein the anchoring member is secured in the at least one recess with a shearable connection;

locating the first tubular member within a second tubular member;

expanding at least the anchor portion of the first tubular member such that the anchoring member engages an inner surface of the second tubular member; and releasing the anchoring member from engagement with the inner surface of the second tubular member.

19. The method of claim 18, further including applying a force to the first tubular member to shear the shearable connection and cause the anchoring member to move from the at least one recess to the second deeper recess.

20. The method of claim 19, wherein the anchoring member moves radially inward when the anchoring member is in the second deeper recess, thereby releasing the anchoring member from engagement with the second tubular member.

21. A method of forming a coupling between tubular members, the method comprising:

providing a first tubular member having an internal surface and an external surface, wherein the first tubular includes an anchor portion comprising at least one recess in the external surface and an anchoring member, wherein the anchoring member is secured in the at least one recess with a shearable connection and the at least one recess includes a tapered profile;

locating the first tubular member within a second tubular member;

expanding at least the anchor portion of the first tubular member such that the anchoring member engages an inner surface of the second tubular member; and releasing the anchoring member from engagement with the inner surface of the second tubular member.

22. The method of claim 21, further including applying a force to the first tubular member to shear the shearable connection and cause the anchoring member to move along the tapered profile of the at least one recess.

23. The method of claim 22, wherein movement along the tapered profile causes the anchoring member to move radially inward, thereby releasing the anchoring member from engagement with the second tubular member.

24. A method of forming a coupling or anchor between two tubular members, the method comprising:

providing a first tubular member having an internal surface and an external surface describing a first diameter, wherein the first tubular includes at least one recess in the external surface at an anchor portion;

locating an anchoring member in the recess, the anchoring member describing an external diameter no greater than the first diameter;

locating the first tubular member within a second tubular member;

expanding at least the anchor portion of the first tubular member such that the anchoring member engages an inner surface of the second tubular member; and releasing the anchoring member from engagement with the inner surface of the second tubular member.

25. The method of claim 24, wherein the first tubular includes a second deeper recess in the external surface and the anchoring member is secured in the at least one recess with a shearable connection.

26. The method of claim 25, further including applying a force to the first tubular member to shear the shearable connection and cause the anchoring member to move from the at least one recess to the second deeper recess.

27. The method of claim 26, wherein the anchoring member moves radially inward when the anchoring member is in the second deeper recess, thereby releasing the anchoring member from engagement with the second tubular member.

28. A method of forming a coupling or anchor between two tubular members, the method comprising:

providing a first tubular member having an internal surface and an external surface describing a first diameter, wherein the first tubular includes at least one recess in the external surface at an anchor portion, whereby the recess is formed at least in part by deforming the first tubular member at the anchor portion to create a localised reduction in external diameter and the deformation occurs while retaining the wall thickness of the tubular member;

locating an anchoring member in the recess, the anchoring member describing an external diameter at a substantially single axial location relative to the first tubular member no greater than the first diameter, wherein the anchor member is a continuous ring;

locating the first tubular member within a second tubular member; and expanding at least the anchor portion of the first tubular member such that the anchoring member engages an inner surface of the second tubular member.

29. The method of claim 28, wherein the anchoring member initially describes a diameter less than the first diameter.

* * * * *